US009776313B2

(12) United States Patent
Hu

(10) Patent No.: US 9,776,313 B2
(45) Date of Patent: Oct. 3, 2017

(54) HAMMER TACKER

(71) Applicant: APEX MFG. CO., LTD., Taichung (TW)

(72) Inventor: Chih-Wei Hu, Taichung (TW)

(73) Assignee: Apex MFG. Co., Ltd., Taichung (TW)

( * ) Notice: Subject to any disclaimer, the term of this patent is extended or adjusted under 35 U.S.C. 154(b) by 142 days.

(21) Appl. No.: 14/969,836

(22) Filed: Dec. 15, 2015

(65) Prior Publication Data

US 2017/0144286 A1 May 25, 2017

(30) Foreign Application Priority Data

Nov. 24, 2015 (TW) ..... 104138969 A

(51) Int. Cl.

| | |
|---|---|
| ***B25C 5/11*** | (2006.01) |
| ***B25C 5/06*** | (2006.01) |
| ***B25C 5/16*** | (2006.01) |
| *B25F 5/02* | (2006.01) |
| *B25D 1/00* | (2006.01) |

(52) U.S. Cl.

CPC ..... *B25C 5/11* (2013.01); *B25C 5/06* (2013.01); *B25C 5/16* (2013.01); *B25D 1/005* (2013.01); *B25F 5/02* (2013.01)

(58) Field of Classification Search

CPC .... B25C 5/00; B25C 5/06; B25C 5/11; B25C 5/16; B25C 5/02; B25F 5/02; B25D 1/005

USPC ..... 227/133, 120, 109, 148, 156, 132, 134, 227/127

See application file for complete search history.

(56) References Cited

U.S. PATENT DOCUMENTS

| | | | | | |
|---|---|---|---|---|---|
| 2,001,092 | A * | 5/1935 | Cavanagh | B25D 1/005 | 227/128 |
| 2,332,257 | A * | 10/1943 | Polzer | B25C 5/16 | 227/109 |
| 2,445,178 | A * | 7/1948 | Lindstrom | B25D 1/005 | 227/133 |
| 2,463,579 | A * | 3/1949 | Vail | B25D 1/005 | 227/133 |
| 2,552,798 | A * | 5/1951 | Lindstrom | B25D 1/005 | 227/133 |
| 2,661,999 | A * | 12/1953 | Abrams | B25D 1/005 | 227/133 |

(Continued)

FOREIGN PATENT DOCUMENTS

| | | |
|---|---|---|
| TW | 576290 U | 2/2004 |
| TW | 201134620 A | 10/2011 |
| TW | I380884 B | 1/2013 |

*Primary Examiner* — Scott A. Smith

(74) *Attorney, Agent, or Firm* — Muncy, Geissler, Olds & Lowe, P.C.

(57) ABSTRACT

A hammer tacker includes a shell and a striking mechanism. The shell is composed of two half-shells which are made of a mixture of 30% to 70% of fiberglass and 70% to 30% of nylon by weight by injection molding. The two half-shells enclose an opening at an end of the shell. Each half-shell has a positioning rib portion facing to the other half-shell. The striking mechanism is arranged in the shell and includes a magazine, a striker, an actuator, and a transmission mechanism. The magazine is positioned by the positioning rib portions. The striker is located at the opening and is movable for striking nails out. The actuator is also movable at the opening. The transmission mechanism connects the striker and the actuator together to make them move oppositely.

9 Claims, 5 Drawing Sheets

(56) References Cited

U.S. PATENT DOCUMENTS

| | | | | | |
|---|---|---|---|---|---|
| 2,896,210 | A * | 7/1959 | Rubin | B25D 1/005 | 227/133 |
| 6,012,623 | A * | 1/2000 | Fealey | B25C 5/11 | 227/133 |
| 6,550,660 | B1 * | 4/2003 | Chlebowski | B25C 5/11 | 227/131 |
| 6,802,443 | B2 * | 10/2004 | Lu | B25C 5/11 | 227/109 |
| 7,654,430 | B2 * | 2/2010 | Cho | B25C 5/1658 | 227/109 |
| 7,726,536 | B2 * | 6/2010 | Gross | B25C 1/06 | 227/131 |
| 7,975,892 | B2 * | 7/2011 | Yeh | B25C 5/11 | 227/133 |
| 8,006,884 | B2 * | 8/2011 | Ebbesson | B25C 5/11 | 227/109 |
| 8,146,789 | B2 * | 4/2012 | Hu | B25C 5/06 | 227/120 |
| 2010/0001033 | A1 * | 1/2010 | Chen | B25C 5/11 | 227/120 |
| 2011/0248065 | A1 * | 10/2011 | Hu | B25C 5/06 | 227/120 |
| 2011/0248066 | A1 * | 10/2011 | Hu | B25C 5/16 | 227/127 |

* cited by examiner

HAMMER TACKER

BACKGROUND OF THE INVENTION

Field of the Invention

The present invention relates to a hammer tacker.

Description of the Prior Art

A conventional hammer tacker is disclosed in patent TW 1380884. The hammer tacker includes two plate-shaped shells and a striking mechanism arranged therebetween. The shells are formed from metal plates or sheets which are bent and perforated. Due to the difficulty to process metal sheets, the shapes of the shells are restricted. Thus, the striking mechanism has to be positioned with additional positioning pieces.

Besides, shells in metal are quite heavy so as to burden users. On the other hand, there must be gap between the metal shell and the metal striking mechanism. Thus, it results noises and shaking when using.

SUMMARY OF THE INVENTION

The main object of the present invention is to provide a hammer tacker which makes less noise and shaking and is lightweight and easy to process.

To achieve the above and other objects, a hammer tacker of the present invention includes a shell and a striking mechanism.

The shell is composed of two half-shells engaged with each other. Each half-shell is formed by injection molding of a mixture of fiberglass and nylon. The mixture is composed of 30% to 70% of fiberglass and 70% to 30% of nylon by weight. The two half-shells enclose an internal space therebetween. A longitudinal direction is defined as a direction perpendicular to a direction along which the two half-shells are aligned. A first end and a second end are defined as two opposite ends of the shell along the longitudinal direction. An opening formed between the two half-shells is defined at the first end. Each of the half-shells is formed with a positioning rib portion on a face facing to the other half-shell wherein the positioning rib portion is close to the second end. A positioning space is defined between the positioning rib portions of the two half-shells.

The striking mechanism is disposed in the internal space of the shell and is made of metal. The striking mechanism includes a magazine, a striker, an actuator, and a transmission mechanism. The magazine is received in the positioning space and is positioned by the positioning rib portions. The striker is arranged at the opening and is linearly movable to strike nails out. The actuator is also arranged at the opening but is more distant from the second end than the striker. The actuator is linearly movable. The transmission mechanism links the striker and the actuator therebetween to make the striker and the actuator move toward two opposite directions. The actuator is moved upward when a bottom portion of the actuator is hit upward.

In conclusion, because the shell is not made of metal but mixture of fiberglass and nylon, weight of the shell is reduced, and noises and shaking are also decreased when using. Besides, with respect to the shell in metal, the shell of the present invention is easy to manufacture and process.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
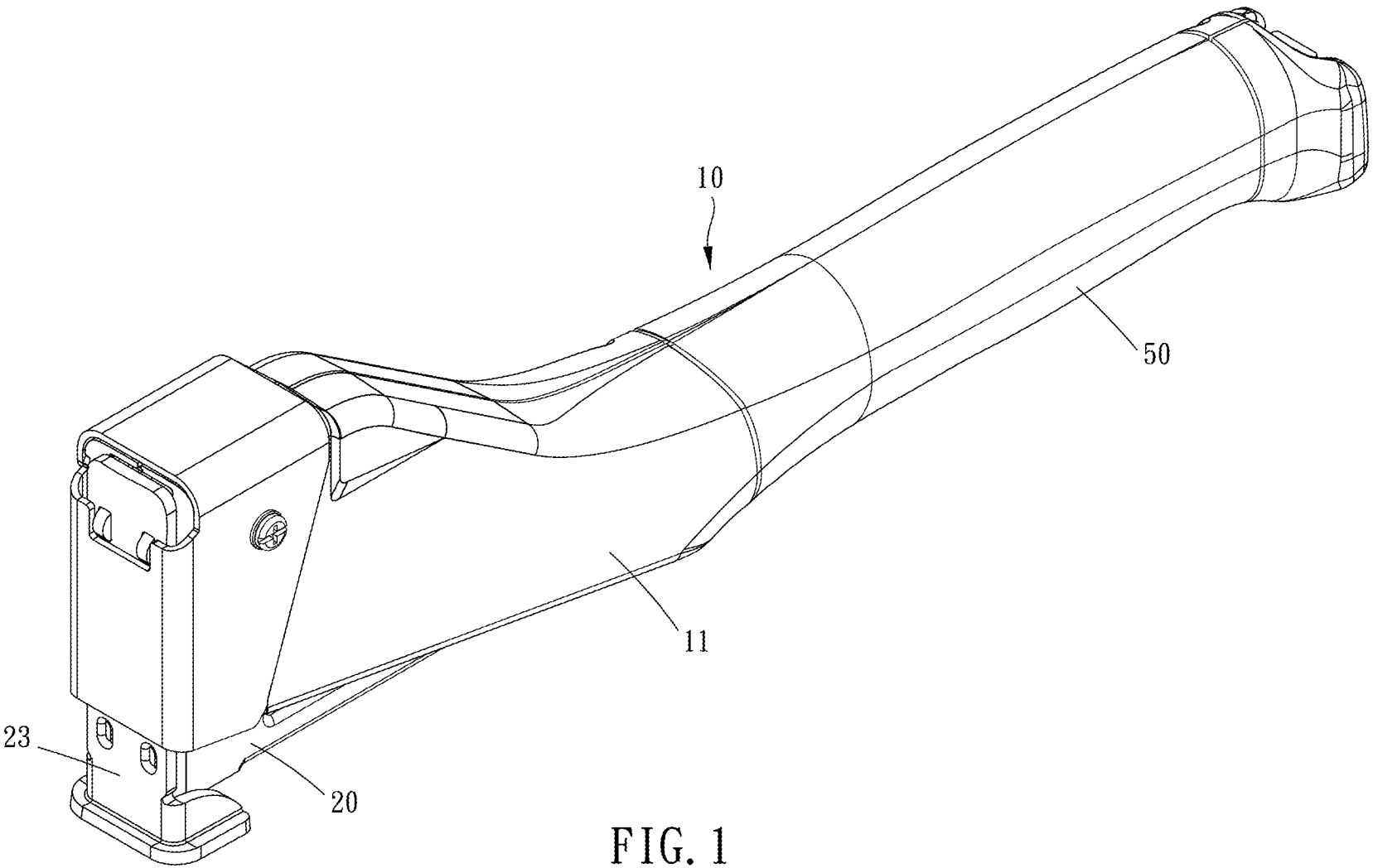
FIG. 1 is a stereogram of the present invention.
Figure 2:
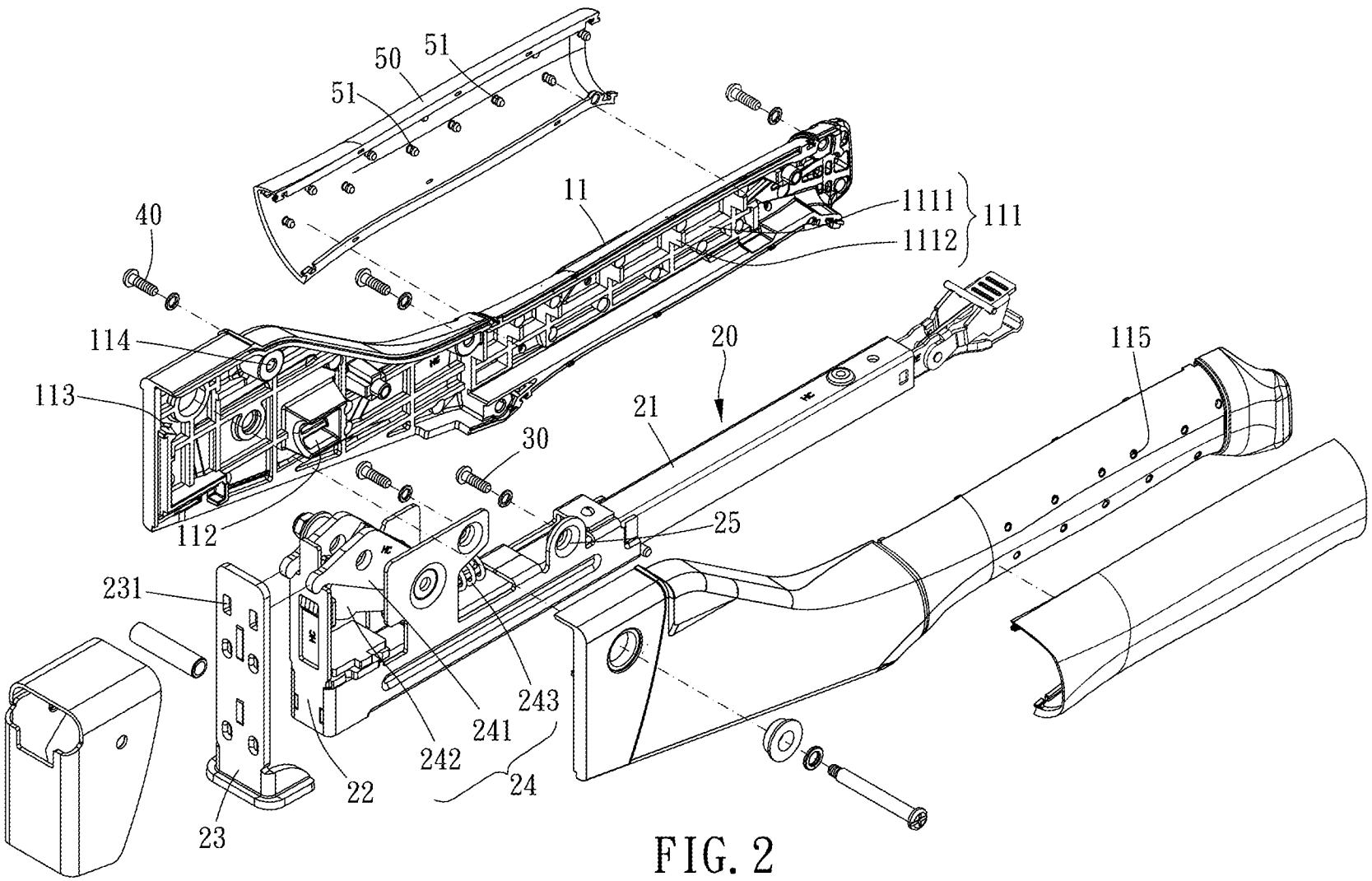
FIG. 2 is a breakdown drawing of the present invention.
Figure 3:
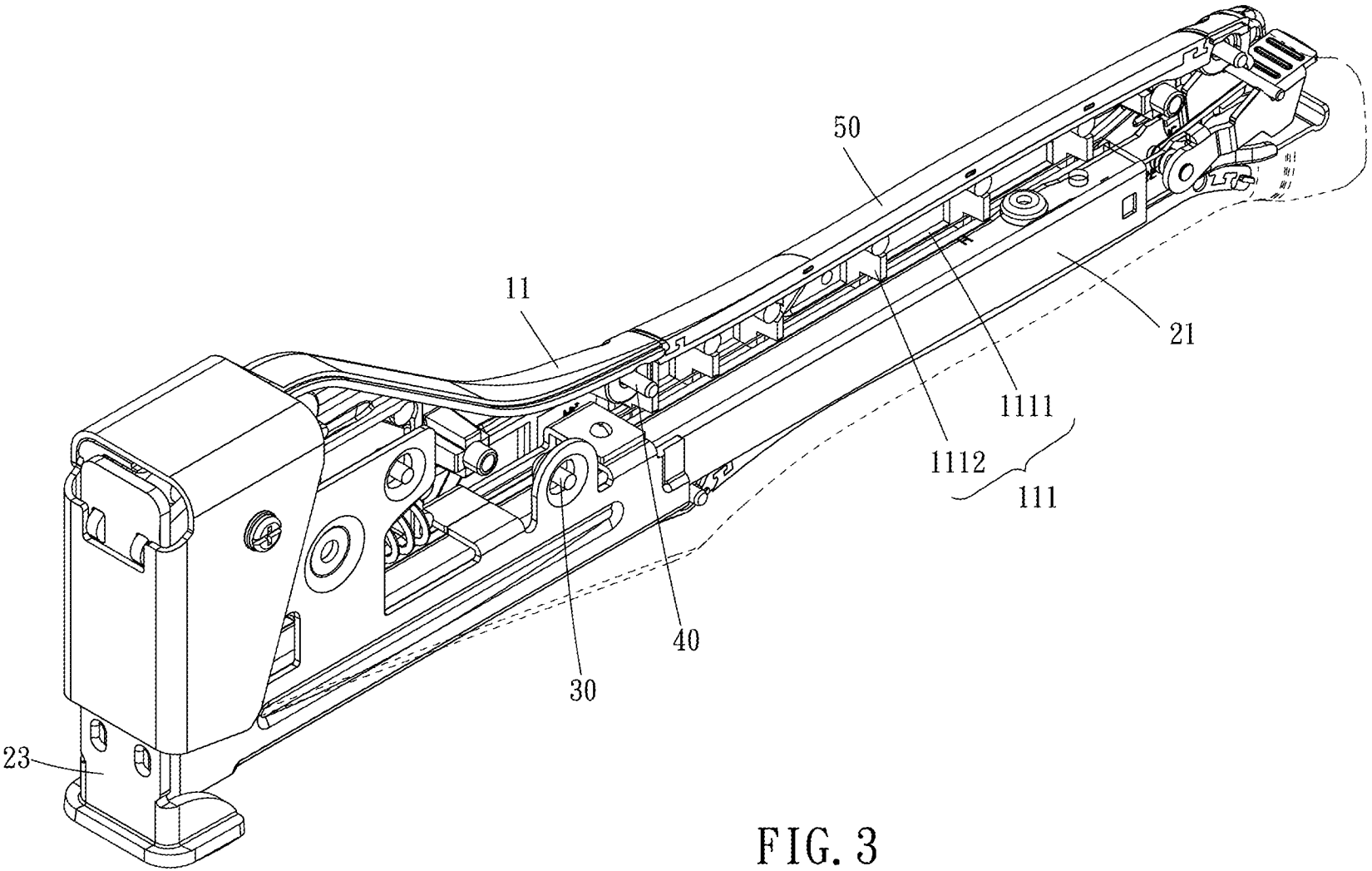
FIG. 3 is a profile of the present invention.
Figure 4:
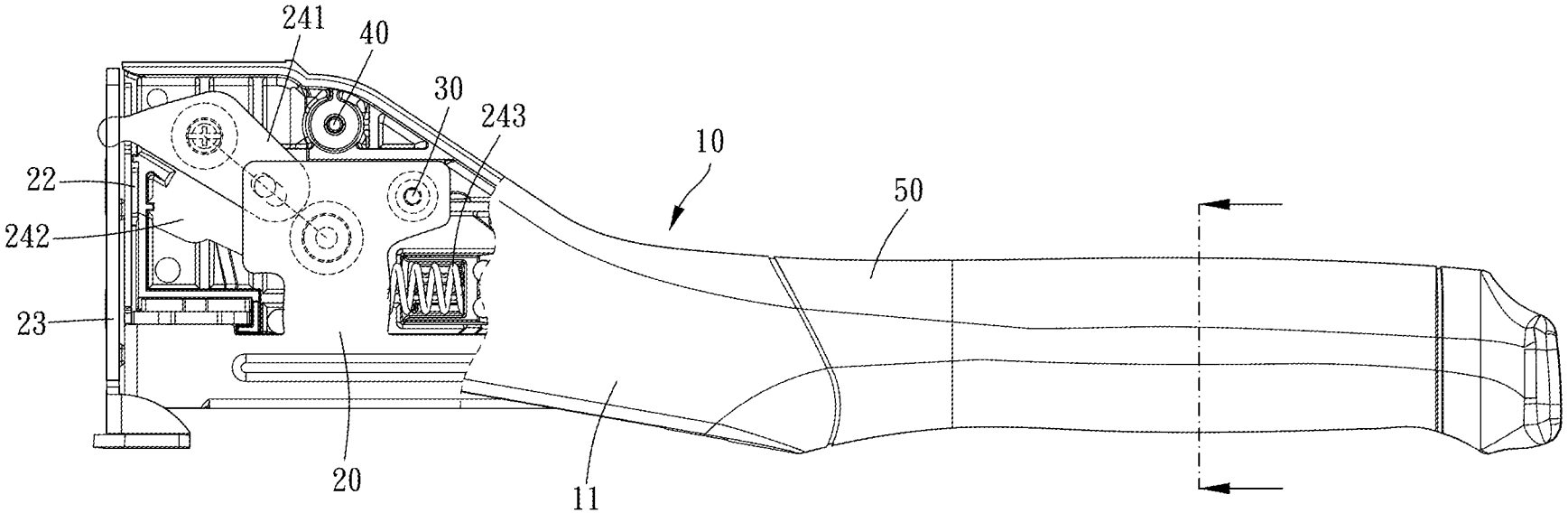
FIG. 4 is a partial profile of the present invention.
Figure 5:
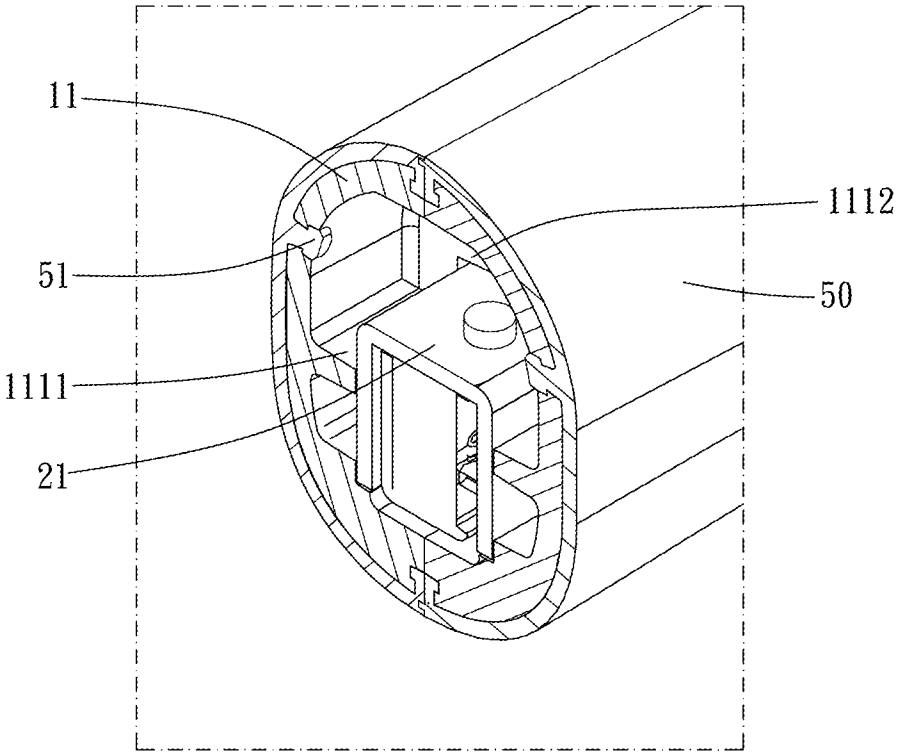
FIG. 5 is a profile of FIG. 4.

Please refer to FIG. 1 to FIG. 5, the hammer tacker of the present invention includes a shell 10, a striking mechanism 20, and two slip-proof portions 50.

The shell 10 is composed of two half-shells 11 having corresponding shapes. The two half-shells 11 are engaged with each other to form the shell 10. Each half-shell 11 is formed with a mixture of fiberglass and nylon by injection molding. The mixture is composed of 30% to 70% of fiberglass and 70% to 30% of nylon by weight. Preferably, the mixture is composed of 50% of fiberglass and 50% of nylon. Additionally, fiberglass and nylon are blended and granulated in advance and then form the two half-shells by injection molding.

The two half-shells 11 define an internal space therebetween. A longitudinal direction is defined as a direction perpendicular to a direction along which the two half-shells 11 are aligned. A first end and a second end are defined as two opposite ends of the shell 10 along the longitudinal direction. An opening is defined between the two half-shells 11 at the first end. Each half-shell 11 is formed with a positioning rib portion 111 near the second end at a face facing to the other half-shell 11. A positioning space is defined between the two positioning rib portions 111. Each positioning rib portion 111 includes a lateral rib 1111 and a top rib 1112. Each half-shell 11 is formed with a half-groove 112, and the two half-grooves 112 enclose a groove. Each half-shell 11 is formed with an inclined face 113 at the opening. The inclined faces 113 partition the opening into an upper portion and a lower portion.

The striking mechanism 20 is arranged in the internal space of the shell 10 and is made of metal. The striking mechanism 20 includes a magazine 21, a striker 22, an actuator 23, and a transmission mechanism 24. The magazine 21 is received in the positioning space and is positioned by the positioning rib portions 111. More specifically, the lateral rib 1111 extends toward a lateral side of the magazine 21 and abuts against the lateral side of the magazine 21. The top rib 1112 abuts against a top side of the magazine 21. The striker 22 is arranged at the opening and is linearly movable to strike nails out. The actuator 23 is also arranged at the opening and is more remote from the second end than the striker 22. The actuator 23 is also linearly movable. The transmission mechanism 24 connects the striker 22 and the actuator 23 together to make them move toward opposite directions. When a bottom portion of the actuator 23 is hit upward, the actuator 23 move upward. Specifically, the transmission mechanism 24 includes a first connecting piece 241, a second connecting piece 242, and an elastic element 243. The first connecting piece 241 is connected with the actuator 23. The second connecting piece 242 connects the first connecting piece 241 and the striker 22 to make the first connecting piece 241 back to an original position. In the present embodiment, The actuator 23 is formed with at least one hook hole 231, and an end of the first connecting piece 241 is hooked on the hook hole 231 to connect to the actuator 23. The elastic element 243 is received in the groove, and an end of the elastic element 243 abuts against the bottom of the groove. The first connecting piece 241 is located above the inclined faces 113 to be restricted to movable only in the upper portion of the opening.

Besides, the striking mechanism 20 has at least one first fixing hole 25. At least one first fixing element 30 is inserted through the first fixing hole 25 to fix the striking mechanism 20 on at least one of the half-shells 11. Each half-shell 11 has at least one second fixing hole 114. At least one second fixing element 40 is inserted through the second fixing holes 114 to fix the two half-shells 11 together. That is, during assembling, the striking mechanism 20 is fixed on one of the half-shells 11 in advance, and then the other half-shell 11 is fixed on the half-shell 11 to cover and position the striking mechanism 20.

Each slip-proof portion 50 is positioned on an outer surface of one of the half-shells 11 and is near the second end. The two slip-proof portions 50 surround the shell 10. More specifically, each slip-proof portion 50 is formed with a plurality of positioning pins 51 on a face facing to the shell 10. Each half-shell 11 is formed with a plurality of positioning holes 115. The positioning pins 51 are inserted into the positioning holes 115 to fix the slip-proof portions 50 on the half-shells 11.

Thereby, the shell made of nylon and fiberglass helps reduce weight, and noises and shaking during using are also reduced. Besides, the shell made by injection molding is easier to manufacture than the metal sheet. Cost is also reduced. Furthermore, the shell can be formed with positioning structures directly by injection molding. Thus, no additional processing is needed.

What is claimed is:

1. A hammer tacker, including:

a shell, composed of two half-shells engaged with each other, each half-shell being formed by injection molding of a mixture of fiberglass and nylon, the mixture being composed of 30% to 70% of fiberglass and 70% to 30% of nylon by weight, the two half-shells enclosing an internal space therebetween, a longitudinal direction being defined as a direction perpendicular to a direction along which the two half-shells are aligned, a first end and a second end being defined as two opposite ends of the shell along the longitudinal direction, an opening formed between the two half-shells being defined at the first end, each of the half-shells being formed with a positioning rib portion on a face facing to the other half-shell wherein the positioning rib portion is close to the second end, a positioning space being defined between the positioning rib portions of the two half-shells;

a striking mechanism, disposed in the internal space of the shell, being made of metal, including a magazine, a striker, an actuator, and a transmission mechanism, the magazine being received in the positioning space and being positioned by the positioning rib portions, the striker being arranged at the opening and being linearly movable to strike nails out, the actuator being also arranged at the opening but more distant from the second end than the striker, the actuator being linearly movable, the transmission mechanism linking the striker and the actuator therebetween to make the striker and the actuator move toward two opposite directions, the actuator being moved upward when a bottom portion of the actuator is hit upward.

2. The hammer tacker of claim 1, wherein the transmission mechanism includes a first connecting piece, a second connecting piece, and an elastic element, the first connecting piece is connected with the actuator, the second connecting piece connects the first connecting piece and the striker therebetween, the elastic element is connected with the first connecting piece to push the first connecting piece to back to an original position.

3. The hammer tacker of claim 2, wherein the actuator is formed with at least one hook hole, an end of the first connecting piece is hooked on the hook hole to connect with the actuator.

4. The hammer tacker of claim 2, wherein each half-shell is formed with a half-groove, the two half-grooves form a groove for the elastic element being received in, a bottom of the groove is abutted by the elastic element.

5. The hammer tacker of claim 2, wherein each half-shell is formed with an inclined face at the opening, the inclined faces partition the opening into an upper portion and lower portion, the first connecting piece is located above the inclined faces so that the first connecting piece is slidable only in the upper portion of the opening.

6. The hammer tacker of claim 1, further including two slip-proof portions, each slip-proof portion being fixed on an outer surface of one of the half-shells near the second end, the two slip-proof portions surrounding the shell.

7. The hammer tacker of claim 6, wherein a face of each slip-proof portion facing to the other slip-proof portion is formed with a plurality of positioning pins, each half-shell is formed with a plurality of positioning holes, the positioning pins are inserted into the positioning holes to position the slip-proof portions on the half-shells.

8. The hammer tacker of claim 1, wherein the striking mechanism has at least one first fixing hole, at least one first fixing element is inserted through the first fixing hole to position the striking mechanism on at least one of the half-shells.

9. The hammer tacker of claim 8, wherein each half-shell is formed with at least one second fixing hole, at least one second fixing element is inserted through the second fixing holes to combine the two half-shells.

* * * * *